United States Patent [19]

Fegan,Jr.

[11] 4,185,746

[45] Jan. 29, 1980

[54] PARTICULATE SIZE SEPARATOR AND METHOD OF OPERATING

[75] Inventor: Lloyd V. Fegan,Jr., Allentown, Pa.

[73] Assignee: Bethlehem Steel Corporation, Bethlehem, Pa.

[21] Appl. No.: 856,816

[22] Filed: Dec. 1, 1977

[51] Int. Cl.[2] ..... B07C 9/00

[52] U.S. Cl. ..... 209/691; 209/695

[58] Field of Search ..... 209/691, 689, 700, 694, 209/658, 661, 695, 696

[56] References Cited

U.S. PATENT DOCUMENTS

| | | | |
|---|---|---|---|
| 474,930 | 5/1892 | Wheelan | 209/695 |
| 871,536 | 11/1907 | Thompson | 209/691 |
| 1,030,042 | 6/1912 | Wilmot et al. | 209/691 |
| 1,259,435 | 3/1918 | Pardee | 209/44.3 |
| 1,283,284 | 10/1918 | Payne | 209/692 |
| 1,318,003 | 10/1919 | Wheeler et al. | 209/45 |
| 1,373,323 | 3/1921 | Goddard | 209/689 |
| 1,479,082 | 1/1924 | Medcalf | 209/691 |
| 1,636,477 | 7/1927 | Medcalf | 209/691 |
| 1,824,915 | 9/1931 | Mitchell | 209/689 X |
| 1,834,658 | 12/1931 | St. Symonds | 209/693 |
| 2,068,146 | 1/1937 | Medcalf | 209/691 |
| 2,662,641 | 12/1953 | Clark et al. | 209/659 |
| 2,892,689 | 6/1959 | Rushford | 209/689 X |
| 3,010,610 | 11/1961 | Marshall et al. | 222/1 |
| 3,507,387 | 4/1970 | Alldred, Jr. et al. | 209/2 |

FOREIGN PATENT DOCUMENTS

| | | | |
|---|---|---|---|
| 1004204 | 3/1957 | Fed. Rep. of Germany | 209/658 |
| 365384 | of 1932 | United Kingdom | 209/691 |

*Primary Examiner*—Robert J. Spar
*Assistant Examiner*—Edward M. Wacyra
*Attorney, Agent, or Firm*—Joseph J. O'Keefe; Charles A. Wilkinson

[57] ABSTRACT

Size separation is effected upon coal, ores, pellets of various sizes and other particulates by depositing the particulate material in an inclined rotating separator vessel having a flat bottom with a central orifice and peripheral sidewalls. As the separator vessel rotates the particulates are carried upwardly and churned by the movement of the vessel. The larger particulates accumulate upon the top of the body of particulates in the separator and eventually overflow over the lip of the vessel while the smaller particulates accumulate in the lower portion of the body of particulates and are then carried up by the movement of the vessel and pass out of the vessel through the central orifice.

19 Claims, 12 Drawing Figures

FIG. 6
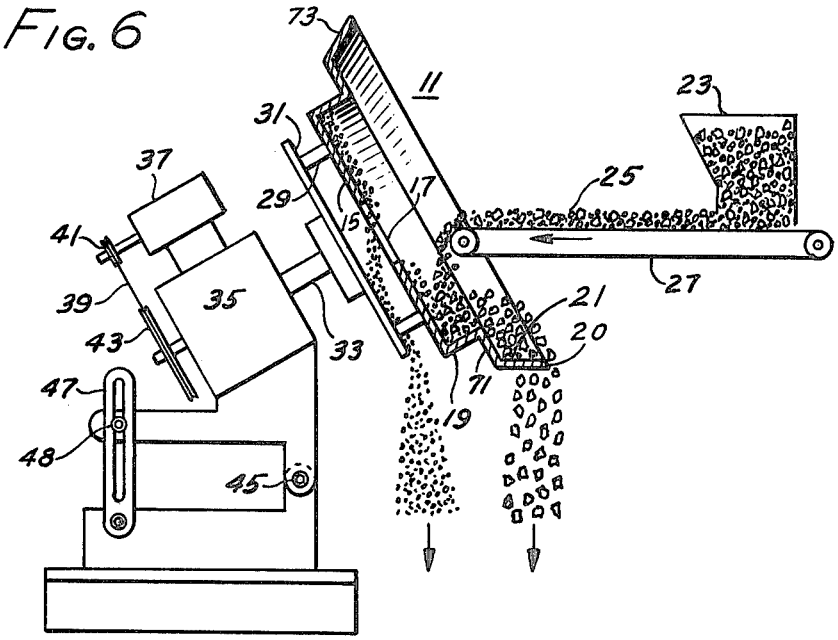
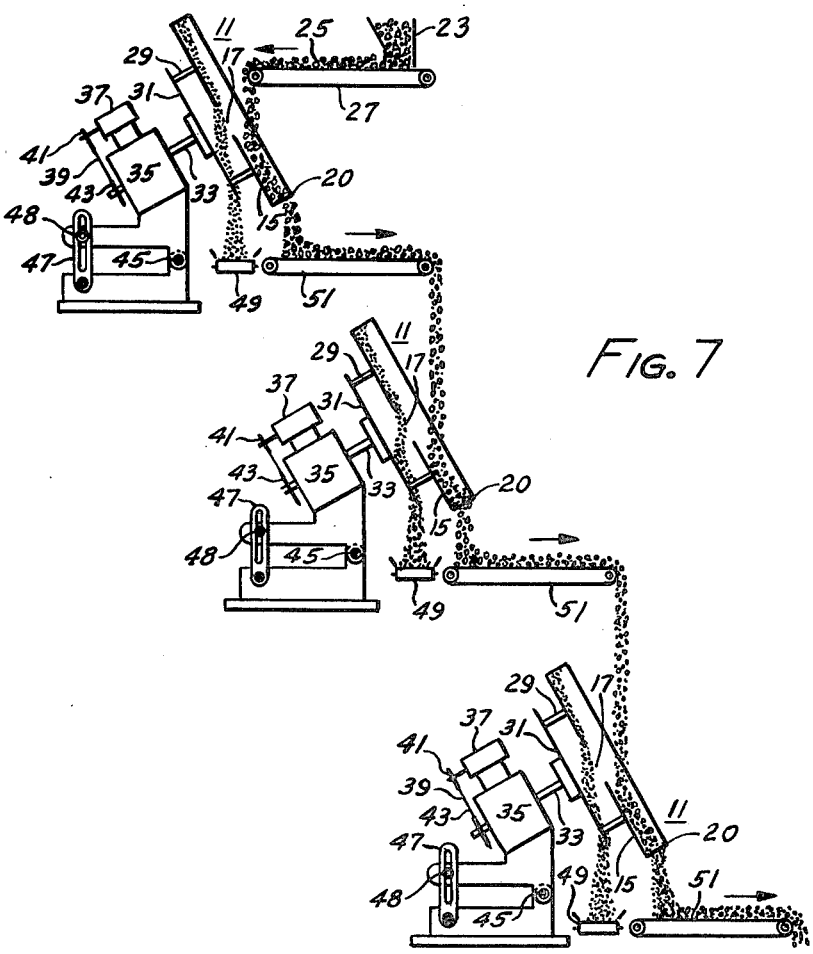
FIG. 7

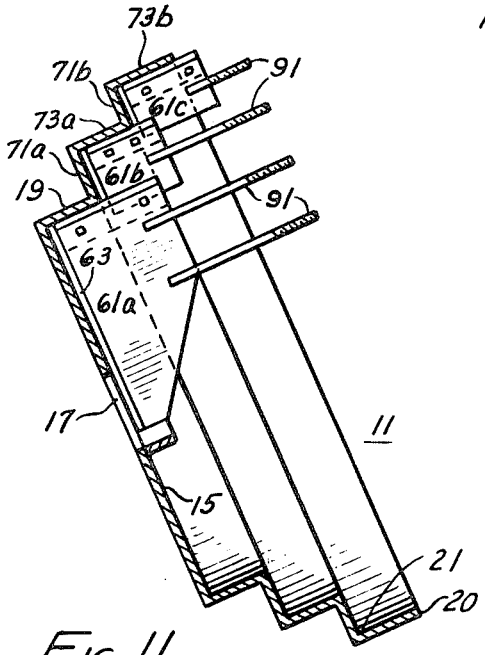
FIG. 11
FIG. 8
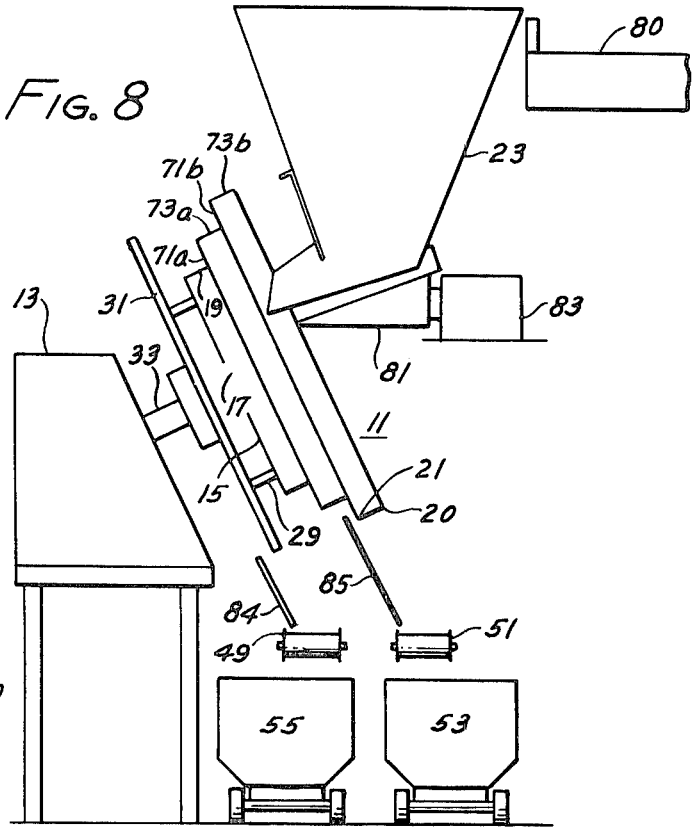
FIG. 9
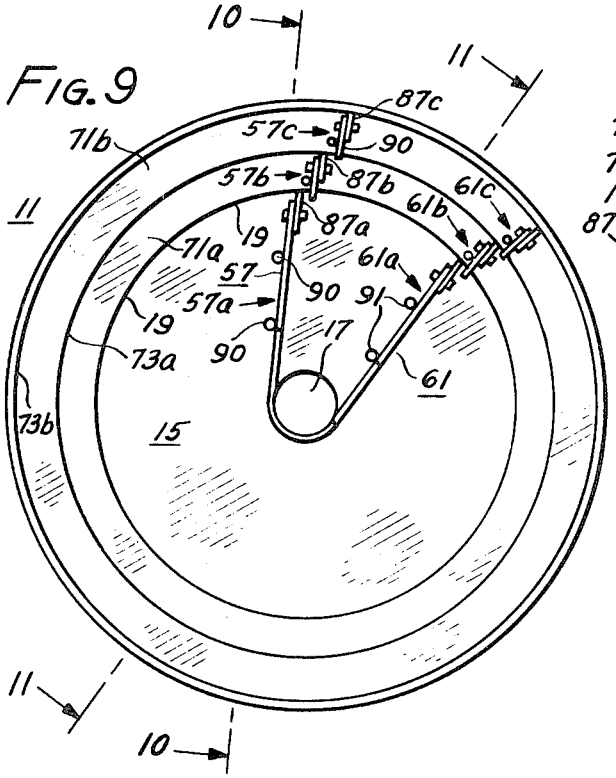
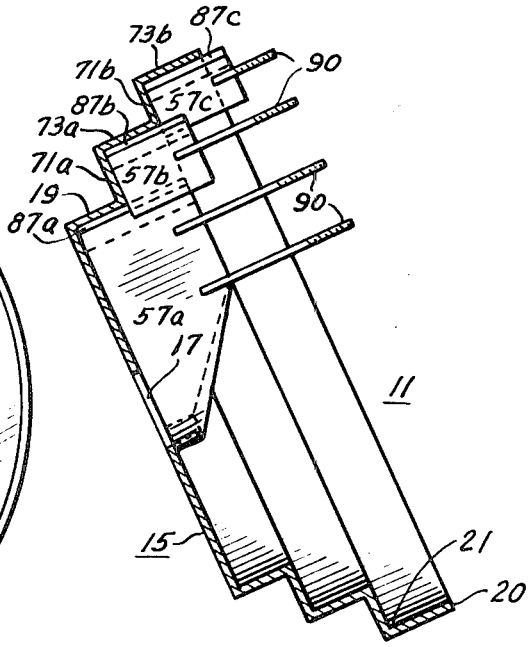
FIG. 10

PARTICULATE SIZE SEPARATOR AND METHOD OF OPERATING

BACKGROUND OF THE INVENTION

This invention relates to the sizing or separation of particulate material into relatively smaller, or finer, and relatively larger, or coarser, sizes.

It is frequently desirable during the beneficiation of coals or ores to crush the material received from the mine and then separate the finer material from the coarser material for later treatment. It is also frequently desirable to separate coals, ores, and other particulates according to size so that the different sizes can be used for various different purposes, subjected to varying treatments, or sold as varying grades. Such size separation has most frequently been accomplished by screening the particulate material. Screening is efficient and simple, but is sometimes not satisfactory for particular materials. Some materials, for example, are so hard and abrasive that a screen is soon worn away, thus requiring frequent and costly replacement. In other cases the material being screened may tend to cling to the screen or clump together, blinding or plugging the screen, or else effectively preventing small particulates from being dislodged from larger particulates. Blinding or plugging of the screen orifices is particularly troublesome in many cases when the particulates are moist or hygroscopic. Slightly moist coal is especially difficult to handle because the fine coal particles and especially coal dust particles cling tenaciously to the wires of the screen, effectively plugging the screen in only a short period.

Various methods of cleaning screens such as by rapping or shaking or the like have been developed, but have not been completely effective, particularly on difficult to separate materials such as moist coal particles. Other nonscreen types of separators such as shaking or vibratory tables, various rotating drum type classifiers, spiral classifiers and the like have been developed, but none has been completely satisfactory either for the separation of coal, ores or other particulates. Furthermore, as the quality of ores has declined and as environmental considerations have increased, requiring the removal of sulfur and the like from coals in particular, finer and finer grinding of various ores and coals has become necessary in order to liberate either desirable or undesirable components. Since grinding requires a significant input of energy, it is desirable not to have to regrind material which is already sufficiently fine. It has thus become more and more desirable to quickly size large tonnages of particulates in the cheapest and most efficient manner.

SUMMARY OF THE INVENTION

The foregoing problems and difficulties of sizing using prior apparatus have now been substantially obviated by the use of the present invention.

In accordance with the invention difficult to size particulates such as abrasive ores, moist ores and coals and the like are deposited in a rotatably journaled separator vessel having a substantially planar bottom and peripheral sidewalls. The inclination of the bottom of the separator vessel is adjusted to about 50 to 75 degrees from the horizontal depending upon the particular fineness of the particulates to be separated. Horizontal as used here means horizontal with respect to the earth, i.e. parallel to the plane of the horizon. Above or greater than horizontal means an angle which extends or is measured in a generally upward direction a certain number of degrees with respect to horizontal, while below or less than horizontal means an angle which is measured or extends in a generally downward direction a certain number of degrees with respect to horizontal. The axis of rotation of the separator vessel is thus inclined at an angle of 15 to 40 degrees with respect to the horizontal. More preferably the axis of rotation may have an inclination of about 25 to 35 degrees with respect to the horizontal. The sidewalls are positioned such that the effective angle of the sidewalls is outwardly and downwardly inclined with respect to the bottom of the separator vessel. The effective angle may be defined as the angle which the sidewalls would, or do, assume if the sidewalls were, or are, in the shape of a regular conical surface. In other words, the effective angle is the nominal angle of the sidewalls if such sidewalls have a regular conical shape. If the sidewalls are not regular, the effective angle will remain the same, but the actual angle of the sidewall may be quite different. The effective angle should be such that the lowest portion of the nominal conical sidewall, i.e. that portion of the sidewall nearest at any given time to the base of the separator or the surface upon which the separator device rests, will have an inclination away from the bottom of the separator from about horizontal to about 15 degrees downwardly from the horizontal. This disposition of the effective or nominal angle of the sidewalls provides an angle of repose for material being treated in the separator vessel which will cause larger particles to roll down the incline defined by the angle of repose and over the outer lip of the separator vessel. In an improved version of the invention the actual preferred angle of the sidewall will be approximately perpendicular with respect to the planar bottom of the separator vessel. Several parallel perpendicular sidewalls may be used. In each of these cases, however, while the actual angle of the sidewalls may be perpendicular with respect to the bottom of the separator vessel, the effective angle will be an obtuse or outward angle which positions an imaginary sidewall at an outward inclination which brings the lower portion of the sidewall to an inclination of from about horizontal or just below horizontal to about 15 degrees downwardly from the horizontal. An effective angle of repose of material in the separator vessel is thus maintained which will cause relatively larger particulates to pass from the separator over the outer lip of the separator vessel. Relatively smaller particulates meanwhile work to the bottom or back of the separator vessel and eventually pass from the vessel through a central orifice provided in the planar bottom of the separator.

A deflector or scraper is preferably disposed adjacent the inner surface of the planar bottom of the separator vessel extending from the upper portion of the sidewalls to the downwardly traveling edge of the centrally disposed orifice in the planar bottom of the vessel so that fines which are carried up on the bottom and sidewalls are deflected downwardly into the central orifice. If the angle of repose of the material in the separator is quite steep and the central orifice is relatively large, small particulates will also flow over the bottom of the central orifice. However, it is usually preferable to have as small a central orifice as possible in order to avoid reducing the active separating surface.

Particulate material to be sized is deposited in the central lower portion of the separator vessel and as the vessel rotates on its axis the particulate material is agitated and churned. Larger particulates work to the surface of the body of churning particulates while smaller particulates and fines migrate or settle to the bottom of the churning mass. When sufficient material collects in the vessel the larger particulates begin to overflow over the lip of the sidewalls. Finer particulates in the meantime are carried up by the rotation of the vessel on the sides and bottom of the vessel and after being deflected by the deflector or scraper fall through the central orifice in the bottom plate. Under some conditions of operation, as explained above, the finer particulates may pass from the separator vessel by flowing over the lower edge of the central orifice as shown in FIG. 5. In other words, under some conditions of operation or with some configurations of separator vessel the fine material may separate directly from the rear or bottom of the churning body of particulates in the separator and flow over the lower edge of the central orifice rather than being carried up by the rotational movement of the separator and being deflected into the central orifice over the upper edge of the orifice.

It is preferable for the sidewalls of the separator to be disposed perpendicularly to the planar bottom disk, i.e. at about 90 degrees more or less with respect to the disk, so that a wedge-shaped body of particulates is formed in the bottom of the separator vessel. The weight of the body of particulates in such case bears down upon the bottom and wedges the particulates against the bottom and sides so that the material does not slide in the vessel. If sliding were to occur the material would merely tend to slide around the inside of the rotating vessel with no churning or over turning and no separation or sizing of particulates would take place. When the sidewalls and the bottom disk, on the other hand, meet at an angle which forms a wedge-shaped trough between them, which trough in combination with the weight of material in the trough will be effective to cause wedging of the particulate body in the space between the sidewalls and bottom, no sliding will occur and effective separation can be attained. This action is referred to herein as frictional wedging. The more particulate matter which is contained in the wedge the greater the force with which the material is wedged in the trough so that although a relatively larger body of particulates may be present no greater tendency to slide will be noted because the wedging action has been increased proportionately. It is preferable for the sidewalls and bottom to be approximately perpendicular to each other, but a greater or lesser angle may be satisfactory so long as an effective frictional wedging action is attained. Since the material in the vessel builds up until the larger particulates begin to spill over the lip, the body of particulates will never become too deep so far as frictional wedging is concerned. However, it may be desirable in order to maintain vigorous tumbling and constant reclassification and sizing to provide a series of shallow frictional wedges at the edge of the vessel in place of a single deep wedge. It may also be desirable to employ a secondary deflector to deflect any oversize particulates, which may occasionally tend to be carried upwardly with the finer particulates, back onto the surface of the agitated mass of particulates in the bottom of the separator vessel.

It has been found in addition to be very desirable to have a large deflector or collector plate positioned in spaced relationship with and just below the flat bottom separator plate of the separator vessel so that the fine particulates which fall through the central orifice are deflected by the collector plate into a suitable subsequent collecting means such as a hopper or conveyor. It is possible also to use a collecting chute leading from the central orifice to a subsequent collecting means, but such a chute will be found less desirable than the collector plate because of the tendency of a chute to plug, especially with moist sticky materials.

BRIEF DESCRIPTION OF THE DRAWINGS

FIG. 6 is a schematic elevation, partly in cross section, of yet another arrangement of the apparatus of the invention.

FIG. 7 is a schematic representation of a series of the separators of the invention operating consecutively upon the same material to provide a more precise overall separation between particulates of different sizes.

FIG. 8 is a schematic representation of a further embodiment of apparatus for practicing the invention.

FIG. 9 is a top view of the separator vessel of the embodiment of the invention shown in FIG. 8.

FIG. 10 is a cross-section of the separator vessel of FIG. 9 along line 10—10 showing the fine particle scraper arrangement.

FIG. 11 is a cross-section of the separator vessel of FIG. 9 along line 11—11 showing the size limiting deflector arrangement.

DESCRIPTION OF THE PREFERRED EMBODIMENT

Figure 1:
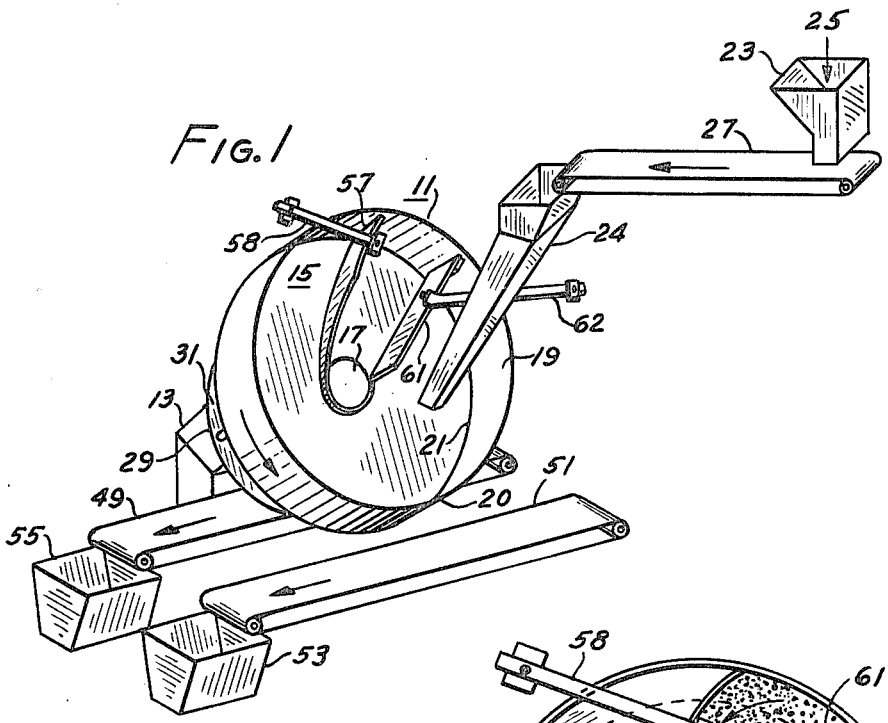
FIG. 1 is an isometric view of a preferred arrangement of separator according to the present invention.
Figure 3:
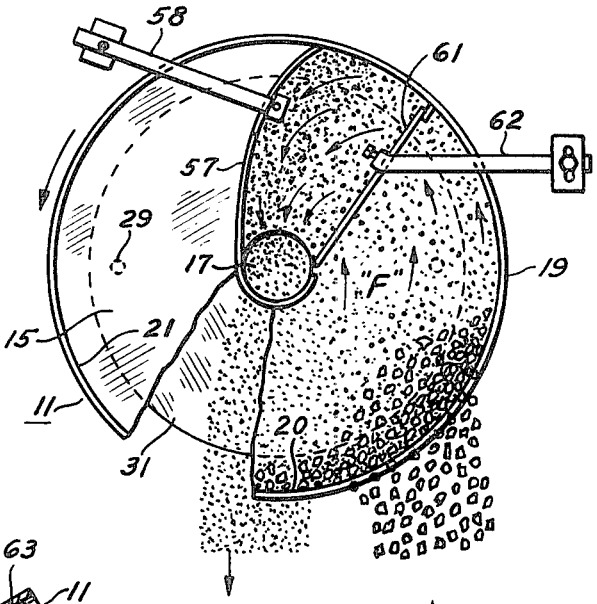
FIG. 3 is a partially broken away enlarged top view of the separator vessel shown in FIGS. 1 and 2.
Figure 2:
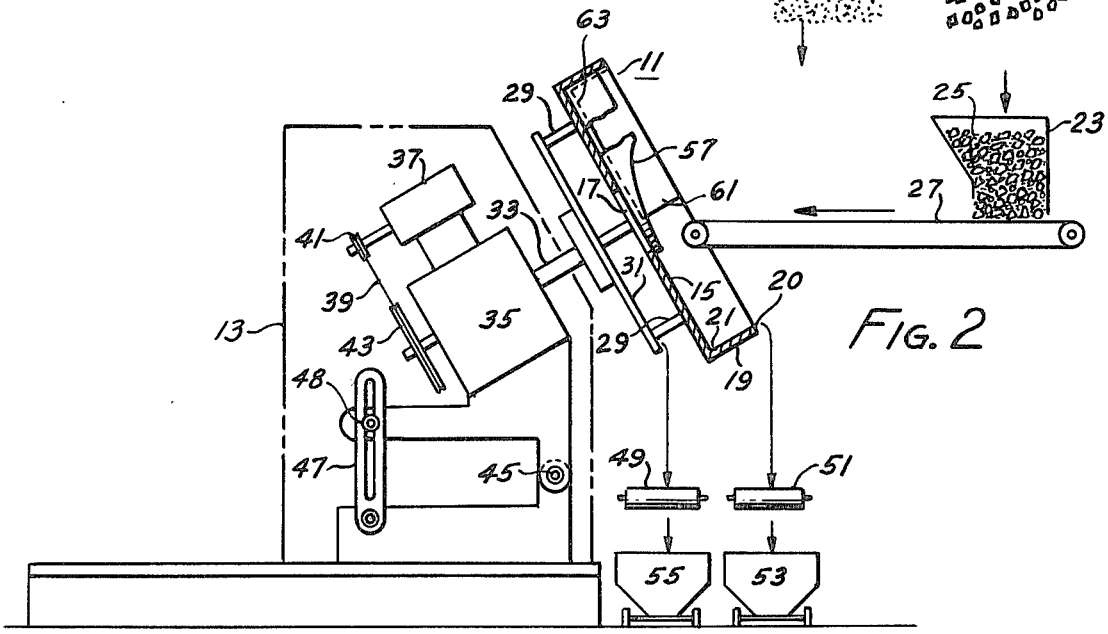
FIG. 2 is a schematic elevation, partly in cross section, of the apparatus shown in FIG. 1.

In FIGS. 1, 2, and 3 there is shown a separator vessel 11 rotatably mounted in a housing 13, which housing is partially shown in FIG. 1 and indicated in FIG. 2 by dotted lines. The vessel 11 is comprised of a planar bottom plate 15 with a substantial, preferably round, orifice 17 in the center. The vessel 11 also has peripheral sidewalls 19 which are disposed perpendicularly to the bottom plate 15 forming a wedge-shaped concavity, or trough, 21 between the planar bottom and the sidewalls. The separator vessel 11 is operatively inclined as shown in the FIGURES with its planar bottom plate 15 extending at approximately a sixty degree angle from the horizontal.

A feed hopper 23 feeds particulate material 25 onto an endless belt type feed means 27 which deposits the particulates in the lower portion of the bottom of the vessel 11 either directly as shown in FIG. 2 or preferably through a feed chute 24 as shown in FIG. 1. The bottom plate 15 of the vessel 11 is connected by suitable spacers 29 to a secondary rotatable deflector, or collector, plate 31 which is mounted on a drive shaft 33 of a variable speed drive unit 35 which is driven by a motor 37 through a belt 39 and drive pulleys 41 and 43. The motor 37 and drive unit 35 are contained in the housing 13. The angle of inclination of the entire unit may be varied through a pivot point 45 and may be locked in position at any effective inclination by slide mechanism 47 and rotatable clamp 48. A conveyor 49 is positioned under the edge of the collector plate 31 in position to receive fine particulates which fall through the central orifice 17 in bottom plate 15 onto the collector plate 31 and are deflected by the collector plate onto the conveyor 49. A second conveyor 51 is positioned under the lip 20 of the sidewall 19 of the vessel 11 in position to catch the larger particulates which pass over the lip 20.

A primary particulate deflector, or scraper, 57 is supported in a stationary position with its lower edge substantially against the bottom of the separator vessel by means of an adjustable support arm or bracket 58 which may be mounted upon any convenient and suitable support structure, such as a floor mounting or the like, not shown. A preferred secondary, or auxiliary, particulate deflector 61 is also supported in a stationary position with its lower edge spaced a predetermined distance from the bottom of the separator vessel, i.e. the top of the planar bottom plate 15, by means of an adjustable support arm or bracket 62 likewise supported upon any suitable primary support, not shown.

In operation the separator vessel 11 is rotated at a peripheral speed of about 100 to 600 lineal feet per minute (30.5 to 182.9 lineal meters per minute) with the bottom plate 15 extending at a preferred angle of about 60 to 70 degrees from the horizontal. For a separator vessel having a five foot diameter this would amount to 6.3 to 38.2 revolutions per minute or broadly about 5 to 40 revolutions per minute. The exact peripheral speed or number of revolutions per time unit and the inclination of the separator vessel will depend upon the material being separated and the throughput of material per unit time desired plus the size of the separator vessel. A larger vessel will ordinarily be rotated at a lesser number of revolutions per minute than a smaller vessel to avoid excessive slippage or churning and possibly adverse centrifugal effects. As a general rule within the above frame of reference, a greater number of revolutions per unit time for any given size of separator vessel will result in a greater throughput of material with comparable efficiency of operation, and a greater inclination of the separator vessel will, as a general rule, result in separation of a finer particulate material from the remainder of the material. In other words, the average size of the small particulates separated from the remainder of particulate aggregate of any particular average size tends to decrease as the inclination from horizontal of the separator vessel increases. It will also usually be found that separator vessels with higher peripheral sidewalls will advantageously have greater operating inclinations from the horizontal than smaller separators.

In operation of the separator shown in FIGS. 1, 2 and 3 a particulate material such as, for example, partially crushed metallurgical coal as it is received from the mine, may be loaded into the feed hopper 23. The partially crushed coal may consist of a mixture of large pieces of coal up to one to three or even more inches (2.54 to 7.62 centimeters) in diameter down to very fine particles of coal of almost dust-like consistency.

Metallurgical coal is used to make coke in a coking operation and in order to attain a good coking operation it is desirable for all the coal to be ground to a more or less consistent fine size less than one eighth inch or, 0.32 centimeter, in mesh size. Since crushing the coal requires a significant amount of energy, it is desirable that such crushing be accomplished as efficiently as possible. It is thus desirable that only the large pieces of coal which actually require crushing be passed to the crushing apparatus, since recrushing of coal particles which are already sufficiently reduced in size is a waste of energy and the fine particles, furthermore, cushion and reduce the overall fracturing of the larger particles and reduce the capacity of the crushers for the coal particulates which do require reduction in size. It is thus advantageous to preseparate the coal particles which require further crushing from the particles which do not. Since the coal is frequently moist as received, such separation is very often not possible by the use of a screen, because the finer particles tend to adhere to and plug (blind) the screen. The use of the separator of the invention, however, very efficiently separates the coarser coal particles from the fine particles, and particularly the very fine particles, and enables these particles to be removed from the coal process stream prior to the crushing operation. While the use of a single separator device may not make an absolutely clean separation between large and small coal particles or particulates, it will be quite satisfactory as a preliminary step to a crushing operation where it will not matter if a small amount of fine material escapes with the coarse product. A more thorough separation can be attained by the use of refinements such as an auxiliary or secondary deflector plate and the arrangement of a series of separators together for consecutive operation upon one coal process stream.

The mixture of coal passes from the hopper 23 onto the belt conveyor 27 which conducts the mixture to a point near the center of the separator vessel 11, but to the side of the central orifice 17. The mixture of coal is deposited preferably into the rolling mass of particulates, but well clear of the accumulation of larger sized particulates. The preferred feed point is shown in FIG. 3 by a designation "F" for feed. The coal mixture falls from the conveyor into the separator vessel and accumulates in the vessel. There the continuous rotation of the separator vessel causes a churning of the body of coal particulates accumulated in the vessel. The rotation of the vessel continuously carries the particulate material a short distance up one side of the vessel on the plate 15 and sidewalls 19 at which point most of the material separates from the plate and sidewalls and rolls back across the surface of the accumulation of coal particulates into the bottom of the separator. A kind of uneven, but generally continuous, rotary motion is set up in the body of coal particulates so that the particulates are carried with the sidewalls and the bottom plate across the bottom of the vessel, up the side a short distance, and then peel away from the vessel at one side of the accumulated body of particulates and flow or roll down across the top of the accumulation of coal particulates. Some of the particulates roll all the way to the far side of the accumulation and others are stopped in their transverse motion part way across the particulate body. A definite churning action is as a consequence set up in the body of particulate material. The larger particulates tend to be buoyed upon the surface of the body of churning particulates, while the smaller particulates tend to be carried or work their way down into the mass of particulates.

As the mass of particulates in the body of particulates increases after initially beginning operation, the height of the body of particulates as a whole will eventually reach a level at which the large topmost particulates begin to spill over the lip 20 of the sidewall 19 onto the belt conveyor 51 which will then convey these large diameter particulates away to any suitable temporary or permanent storage such as the movable hopper 53. The rotation of the separator vessel causes the particulates to spill over the lip 20 from about the 3 o'clock position to about the 5:30 o'clock position with the larger particles tending to exit from the separator in the lower portions of this general range. Most of the material will exit from the separator vessel at about the 4 o'clock position. The continuous rotation of the vessel 11 meanwhile continuously strips fine particles from the bottom of the mass or body of particulates and carries them upwardly to the top portion of the vessel where they are dislodged by the primary particulate deflector, or scraper, 57 from the surface of the bottom plate 15 and deflected downwardly into the central orifice 17 from which the fine particles drop onto the rotating lower collector plate 31. The fine particulates slide down the inclined upper face of the collector plate 31 and are discharged onto the conveyor belt 49 which then conveys the particulates to a suitable temporary or permanent storage facility such as the movable hopper 55. It will be understood that either the fine or coarse particulates might also be transported by suitable extensions of the conveyors 49 or 51 respectively to the point of ultimate use which for the fines might, for example, be a coal coking operation and for the coarser material might, for example, be a crushing operation. Naturally any other suitable type of conveying means could be used to replace the endless belt conveyors shown.

As the mass of particulates accumulates in the separator vessel it builds up in the concavity, or trough, 21 between the planar bottom and the sidewalls of the vessel. When it reaches the lip 20 of the sidewall it can build no higher on this side. However, since the lower edge of the orifice 17 in the bottom of the separator is at a higher elevation, the mass of particulates continues to build up near the bottom of the separator vessel forming an outwardly inclined surface on the churning mass of particulates. When the angle of repose of the dynamic churning mass is reached, a surface corresponding to this angle of repose is maintained on the mass. It is down this inclined surface which the larger particulates roll and accumulate upon until they spill over the lip 20 of the sidewall. After the concavity 21 is filled and the angle of repose attained, operation continues as though the sidewall of the separator at the bottom also has a downward inclination or an effective angle, not as great as the angle of repose, but slightly downward nevertheless. However, no slippage of the mass of particulates with respect to the bottom of the separator will occur. The downward inclination of the effective angle of the sidewall of the frictional wedge type arrangement is more evident in the illustrations of other preferred embodiments of the invention shown in FIGS. 4, 6 and 8 where multiple frictional wedge arrangements are shown and described.

If the orifice in the bottom of the separator vessel was sufficiently large, the small particulates would begin to overflow out the central orifice before the normal angle of repose was attained. This also would cause effective separation according to particle size and the separator of the invention can be effectively operated in this manner as one embodiment. See, for example, FIG. 4.

However, separation has been found to be more effective with most materials if the central orifice is not large enough to intersect the angle of repose, as is the case in the preferred embodiment illustrated in FIGS. 1 and 3, and the fines are carried up around the separator and allowed, or urged, to drop through the central orifice. This is particularly so where the length of the sidewalls, or, in other words, the depth of the separator vessel is not great. In a shallow separator the distance between the lip of the sidewalls and the edge of the central orifice may not be sufficient to attain efficient separation. The actual operating distance between the two points, of course, depends not only on the depth of the separator, but also upon the width and operating angle of the separator.

In general the angle of repose of the body of particulates within the separator vessel will be less when the speed of rotation is higher and greater when the speed of rotation is less. Thus at low rotational speeds a considerable amount of small particulate material may approach or even reach the lower edge of the central orifice even when this orifice does not have a large diameter. Such small particulate material will spill or flow over the lower edge of the central orifice and fall together with small particulates which pass over the top edge of the central orifice through the central orifice. In normal operation, however, of the preferred form of separator as illustrated in FIGS. 1, 2 and 3, the largest portion of the fine particulate material will enter the central orifice across the top edge of the orifice. This will usually provide the most effective separation of very fine particulates from coarser material.

In a preferred embodiment of the separator as shown in FIGS. 1, 2 and 3 a secondary, or auxiliary, particulate deflector plate or sizing deflector 61 may be positioned in the upper portion of the separator vessel adjacent the near side of the central orifice 17. The bottom of this sizing deflector is positioned a specified distance from the surface of the bottom plate or disk 15, which distance or gap 63 is equal to or greater than the diameter of particulates just above the desired size separation to be made. The gap 63 can be seen in FIG. 2 and also FIG. 11 with respect to a later described embodiment. As the vessel rotates any particulates larger than this predetermined gap size are deflected back by the secondary deflector 61 and fall downwardly into the mass of churning particulates in the lower portion of the separator vessel, while particulates smaller than the predetermined gap size pass under the secondary deflector 61 and continue on to the principal particulate deflector, or scraper, 57 which deflects these fine particulates into the central orifice 17. The sizing deflector 61 will in most installations be positioned so that the deflector gap size will be only slightly greater than the desired separation size.

However, if the separation size for the particular material being treated is such that a major proportion of the separated material will be fines it may be necessary to increase the gap size. In such case the coarse material will tend to be carried upwardly partially supported upon the fines and the coarse material can be deflected backward and downward by a higher positioned deflector. On the other hand, with a high percentage of fines too small a deflector gap size will seriously interfere with the throughput of the separator. Thus, when the percentage of fines is from fifty to perhaps eighty percent of the material to be separated, the gap size may be as much as two or three times the desired separation size. In any case the deflector gap 63 must provide a total cross-sectional area at least equal to the instantaneous cross-sectional area of the volume of fines to be separated or passed through said gap per unit time necessary for such passage.

The principal, or primary, particulate deflector, or scraper, 57 is shown in the FIGURES as having a generally curved shape with the convex side extending in the direction of rotation of the separator vessel and an extension of progressively decreasing height extending around the perimeter of the central orifice almost to the secondary particulate deflector 61. This arrangement aids in deflecting particulates into the central orifice yet allows ready observation by the operator of the flow or deflection of fine particulates into the central orifice. It will be understood, however, that the primary deflector or scraper could also be straight rather than curved, could be the same height throughout, and is required only to extend from the vicinity of an upper portion of the sidewall to the far upper edge (with respect to rotation of the separator) of the central orifice.

It is important, in order to obtain a proper churning and mixing action in the body of particulates in the bottom of the separator vessel, for the lower portions of the body of particulates to adhere to the surface of the bottom plate or disk 15 until separated from the plate at a fairly elevated point on the upwardly moving side of the separator vessel. If the lower portions of the body of particulates do not adhere sufficiently to the plate surface, the surface of the separator will merely move or slip under the particulate mass. The mass of particulates will then as a whole merely slide across the bottom of the separator vessel while remaining in a single more or less coherent mass. No separatory action will in this case be effected upon the particulates except that some very fine particulates may be removed from the bottom of the mass and carried upwardly to be deflected into the central orifice 17.

In order to prevent the mass of particulates from sliding in the separator vessel, it is possible to place weld beads or other raised areas upon the surface of the bottom plate or disk 15. The raised areas should be positioned transversely of the direction of rotation of the vessel. It is also possible to generally roughen the entire bottom surface of the vessel by some suitable means such as by the application of a suitable plastic overcoating containing sand or carborundum particles or the like. This latter expedient will be found in some cases to increase the dragout of fine particles also and thus increase the rate of separation. It has generally been found preferable, however, in order to prevent sliding of the mass of particulates, to arrange the angle between the bottom plate or disk of the separator vessel and the sidewalls of the separator vessel to be either a right angle or an acute angle, or more generally any angle which for the mass and consistency of the particulates involved will cause a "sufficient wedging" of the mass of particulates in the concavity or trough 21 formed by the angle between the bottom plate or disk 15 and the sidewall 19 of the inclined separator vessel. A "sufficient wedging" is an amount which will induce sufficient frictional interaction between the particulate mass as a whole and the interior surface of the separator to prevent slipping or sliding of the particulate mass as a whole. It will be found generally that a very preferable angle between the disk surface and the sidewall for most particulates will be approximately a right angle, i.e. 90 degrees plus or minus approximately five or ten degrees. Larger obtuse angles can also be used, particularly if some degree of roughness or unevenness is imparted to the inside of the separator vessel. It will generally, however, not be desirable to have a significant acute angle between the plate or disk surface and the sidewalls because a pocket will then be formed in which particulate material may be trapped and tumbling of the mass of particulates may be decreased. For some particularly slippery particulates, however, it may be desirable to use a slight acute angle in order to increase the relative depth of the mass of particulates. An acute angle, i.e. an angle slightly less than 90 degrees, may be particularly desirable when the angle of inclination of the vessel as a whole is large, i.e. close to 70 degrees or more with the horizontal. An effective concavity or trough between the bottom plate and the peripheral sidewalls of the separator vessel may be conveniently referred to as a friction wedge.

Figure 4:
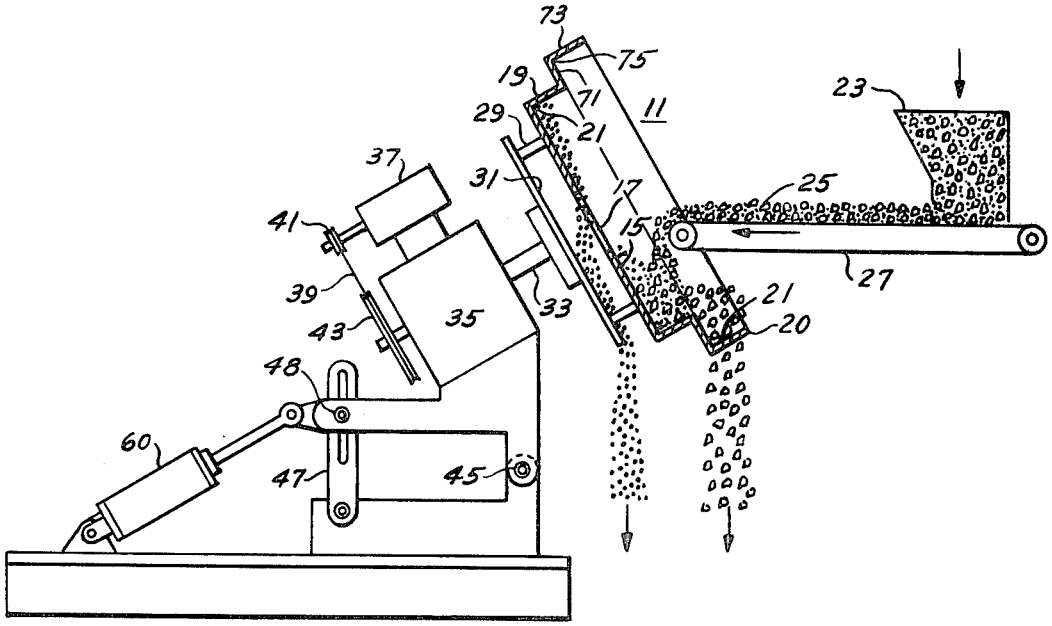
FIG. 4 is a schematic elevation, partly in cross section, of an alternative arrangement of apparatus according to the invention.

In FIG. 4 there is shown a schematic cross-sectional view of an alternative or improved arrangement of the separator device shown in FIGS. 1 and 2. Most of the parts of the apparatus shown in FIG. 4 are identical to those shown in FIGS. 1 and 2 and the same identifying numerals are used to designate such parts in all three FIGURES. At the outer end of the circumferential sidewall 19, however, there is secured a circumferential ring 71 which is preferably disposed generally parallel to the bottom plate 15 of the separator vessel. At the outer edge of the circumferential ring 71 there is secured a second peripheral sidewall 73 which is disposed preferably parallel to the first sidewall 19. The height of the two sidewalls 19 and 73 will generally be approximately equal. Since the bottom plate 15 and circumferential ring 71, and the peripheral sidewalls 19 and 73 are respectively parallel to each other, similar trough or wedge openings 21 and 75 are formed between each sidewall and the adjacent plate or ring. Thus, the separator vessel shown in FIG. 4 incorporates two friction wedges. The mass of particulates spreads itself between the two troughs or friction wedges so that a large mass of particulates can be accommodated at one time with a very satisfactory overall wedging action which prevents sliding of the mass, yet the depth of the mass in the two troughs is not so great that large particulates tend to become buried in the mass as a whole. Additional capacity can thus be attained in the separator vessel while minimizing any tendency of the mass of particulates as a whole to slide. If desired more than one additional trough or friction wedge can be provided by arranging a series of circumferential rings and sidewalls extending radially one after the other from the main separator plate or disk and sidewall. Additional separator capacity can be provided in this manner while maintaining both good frictional wedging and good tumbling and agitation of the particulate mass as a whole. A triple friction wedge arrangement is shown in additional detail in FIGS. 8, 9, 10 and 11. An inclination actuator 60, which may be a hydraulic cylinder or the like, is also shown in FIG. 4. While larger separators with multiple friction wedges provide additional separator capacity it has been found that in general the additional capacity is not proportional to the increased size or number of friction wedges. A single or double friction wedge arrangement thus at this time appears to be the most efficient arrangement.

The two friction wedges shown in FIG. 4 have equal dimensions and shapes. If a curvilinear or plane curved surface is imagined laid across the tops or along the bottoms of the friction wedges, the angle of the lower portion of the imaginary surface with the horizontal will be recognized to constitute the effective angle or inclination of the wall as a whole of the separator vessel with the horizontal. The angle of repose of the particulates will then be established with respect to this angle, the angle of repose being, however, greater than the effective angle. The effective angle of the sidewall determines the direction of the angle of repose.

While not shown in FIG. 4 in order not to obscure the view of the particulates in the separator vessel, it will be understood that a suitably shaped primary deflector plate, or scraper, and also, if desired, secondary deflector plate, will be used in the separator vessel. Such a deflector plate should have two scraping surfaces, one of which is positioned closely adjacent to the separator plate 15 and one of which is positioned closely adjacent to the circumferential ring 71. The deflector may be formed in one piece or may be formed in two or more separate pieces similar to the multipartite deflectors shown in FIGS. 9 and 10 in connection with the embodiment of the invention illustrated particularly in FIG. 8.

Figure 5:
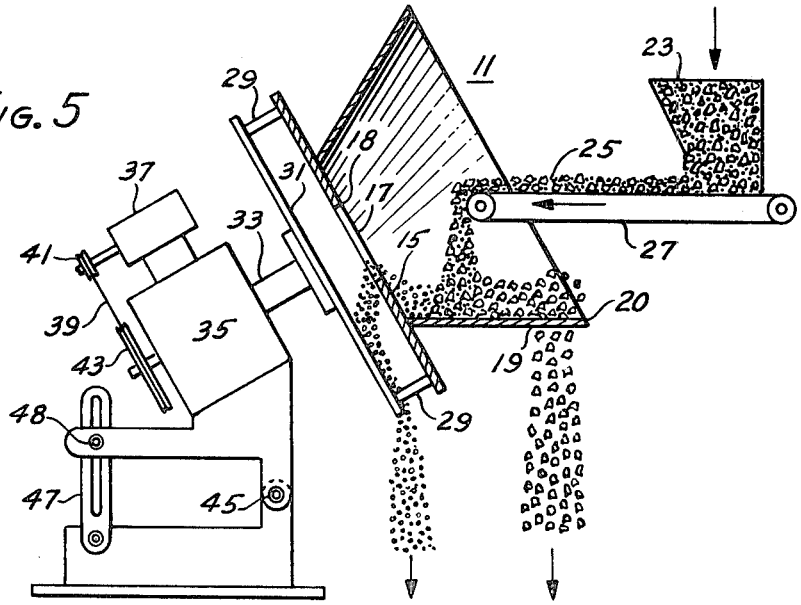
FIG. 5 is a schematic elevation, partly in cross section, of still another possible arrangement of the apparatus of the invention.

FIG. 5 is a schematic cross sectional view of still another embodiment of the apparatus of the invention. In FIG. 5 there is shown an apparatus which is substantially identical to the apparatus in FIGS. 2 and 4 except for the shape of the separator vessel. Similar designation numerals have been used to designate similar structures in the two FIGURES. The separator plate 15 and collector plate 31 of the separator are substantially the same as in the previous embodiments also. The sidewall 19, however, is disposed at a substantial obtuse angle with respect to the interior surface of the separator plate such that the lowest portion of the curved sidewall is disposed almost horizontally with respect to the environment. The sidewall is shown substantially horizontal, but could be anywhere from just slightly less than horizontal to 10 to 15 degrees less than horizontal. The height or length of sidewall 19 is also considerably increased from the height shown in the other embodiments. As may be seen the sidewall does not incorporate the preferred friction wedge structure of the previously illustrated embodiments and the effective angle of the sidewall substantially coincides with the actual angle of the sidewall.

The operation of the embodiment of FIG. 5 is substantially the same as in the other FIGURES in that a mass of particulates forms in the bottom of the separator vessel and is imparted a rolling and tumbling action by which separation of particulate sizes is effected. The mass of particulates tends to build up near the back or bottom of the separator vessel. Larger particulates are buoyed up on the top of the mass and roll down the slight incline of the mass of particulates until they overflow from the lip 20 of the sidewall. Fine particulates, on the other hand, sink to the bottom of the agitated mass of particulates gathering at the back of the sidewall near the separator plate and building up near the separator plate until they overflow through the central orifice. Since most of the fine materials overflow across the lip 18 of the central orifice 17 rather than rolling down into the orifice from above, no deflector plate or scraper is usually necessary in the embodiment of the invention shown in FIG. 5 when the separator is operated at low speeds. However, it will usually be found convenient to have a deflector or scraper to prevent adherence and buildup of particulate material upon the bottom and sides of the separator vessel. At higher operating speeds the deflector may also be necessary to keep the fine particulates passing smoothly through the central orifice. The necessity for a scraper will actually be determined by the angle of repose established by the dynamic churning mass of particulates and the relative size of the central orifice 17. If the angle of repose is relatively shallow and the central orifice is relatively small so that insufficient particulates accumulate to build up to the level of the orifice, no particulates will spill over the lip of the orifice. In this case it will be necessary to rely upon fine particulates being carried up on the bottom of the separator vessel and a scraper will be required to direct the fine particulates into the central orifice.

The embodiment of the invention shown in FIG. 5 has the considerable advantage of having a very high throughput or production rate and is particularly useful for the sizing of particulates which have little tendency to slide and which contain a fair percentage of large particles with not too much very fine material. It will be found generally, however, that the embodiments shown in FIGS. 1, 2 and 4 are more efficient for sizing most particulate materials. The main advantage of the embodiment shown in FIG. 5 is that there is little chance for large particulates to become trapped in the wedge or troughs which are present in the previous embodiments of the invention in those cases where the consistency of the particulate mass is such that such entrapment might tend to occur. The overall arrangement, furthermore, with a minimum of angles and no necessity for a scraper or secondary deflector, provides a very high production rate. Unfortunately, many particulates show a tendency to slide within the separator. Such sliding will completely destroy the separatory action of the device. While sliding can be counteracted temporarily by roughening the inside surface of the separator vessel, such roughening is quickly smoothed out or filled in by adhesion of most particulate materials so that the inside surface quickly becomes, in effect, smooth. Only a relatively few types of particulates are suitable for efficient separation in the embodiment of FIG. 5, therefore. Coarse material in general has been found to have a minimum tendency to slide and is consequently suitable for effective separation in the cone type separator of FIG. 5.

The sidewalls 19 in FIG. 5 define essentially a conical tumbling area in which separation of large and small particulates occurs. The apex end of the conical sidewalls is positioned, as shown, near the central opening in the separator so that the smaller particulates can easily overflow through the central orifice. It is also possible to position the sidewalls nearer the edge of the separator plate at some distance from the central orifice 17 so that fine particulates are carried upwardly by the separator plate and deflected by a particulate deflector or scraper in the same manner as in the preferred embodiments of the invention shown in FIGS. 1, 2 and 4. When much fine particulate is present, however, it will usually be found to be more efficient to use the preferred friction wedge type sidewall arrangement shown in FIGS. 1 and 2 or FIG. 4.

In FIG. 6 there is shown a schematic cross sectional representation of a still further embodiment of the invention. Again most of the parts of the apparatus are the same as in the prior FIGURES and the same designating numerals are used to refer to similar parts. The embodiment shown in FIG. 6 is most similar to the embodiment of FIG. 4. In FIG. 6 the first sidewall 19 of the separator vessel is disposed perpendicularly to the inclined separator plate as in FIGS. 1, 3 and 4, but the second peripheral sidewall 73 is inclined at an obtuse angle with respect to the surface of circumferential ring 71 so that the sidewall 73 is approximately horizontal at its lower end. The operation of the separator is essentially the same as the separator shown in FIG. 4 except that there is less chance for large particulates to become trapped in the last or outermost friction wedge, while at the same time very good wedging action is attained in the first friction wedge to prevent sliding of the particulate mass in the separator vessel. The large particulates roll easily down the inclined surface of the mass of particulates and are discharged from the lip of the separator. As in FIG. 4 it will be understood that a suitably shaped primary and, if desired, secondary deflector will be positioned within the separator vessel.

In FIG. 7 there is shown an arrangement of a series of separators in accordance with the invention in which each separator vessel except the last feeds its large particulates into a succeeding separator vessel. Fine particulates are separated from the mass of particulates in each succeeding vessel to attain a very clean separation overall between the large and small particulates. Each separator vessel is illustrated as being a separator vessel such as shown in FIG. 2. It will be understood, however, that each separator could also be constructed in accordance with one of the other embodiments illustrated.

In FIG. 8 there is a further embodiment of the invention. This embodiment is designed particularly for large diameter separator vessels six or more feet in diameter (approximately two meters) for use in separating or sizing ores or coal. Since most of the parts of the separator apparatus shown in FIG. 8 are substantially identical or similar to those shown in FIG. 4 the same identifying numerals are used to identify similar structures and parts. The principal difference between the embodiment of FIG. 8 and the embodiment of FIG. 4 is the fact that the embodiment of FIG. 8 incorporates three friction wedges rather than two. Thus in FIG. 8 there are two circumferential rings 71*a* and 71*b* and two peripheral sidewalls 73*a* and 73*b*. The feed hopper 23 has its upper edge extending just slightly above the level of a second floor 80 to facilitate loading of the hopper from mobile wheeled transport means such as trucks or the like, not shown. The hopper feed is shown as a vibratory hopper feed means 81 operated by a motor 83. Motor and gear reducer means for rotating the separator vessel 11 are contained within the housing structure 13. Particulate guide plate means 84 are provided to guide or direct fine particulates from the rotatable collector plate 31 onto conveyor 49 and a similar guide plate means 85 is provided to direct coarse particulates which overflow over the lip 20 of the separator vessel 11 onto conveyor 51.

In FIG. 9 there is shown a top or plan view of the separator vessel 11 of the embodiment of the invention shown in FIG. 8 showing in particular the arrangement of primary and secondary deflectors used in the vessel. FIG. 10 is a cross-section of FIG. 9 along 10—10 and shows the vertical arrangement of the components of the primary deflector or scraper. It will be noted that the primary deflector or scraper 57 is formed in three separate sections 57*a*, 57*b* and 57*c*. Section 57*a*, the largest section, is positioned adjacent to the bottom or separator plate 15 of the separator vessel 11 while sections 57*b* and 57*c* are positioned adjacent to the circumferential rings 71*a* and 71*b* to deflect or scrape fine particulates from these rings. Each section of the deflectors is provided with a rubber wiper 87*a*, 87*b* or 87*c* to wipe the adjacent section of the peripheral sidewalls 19, 73*a*, or 73*b* respectively to remove adhering fines therefrom. The scrapers are mounted upon any convenient primary bracket means, not shown, by means of the secondary bracket rods 90.

The secondary, or sizing, deflector 61 is also formed in three separate sections 61*a*, 61*b* and 61*c* with appropriate rubber or similar wipers in the same manner as the primary deflector or scraper. See FIG. 11. It will be understood that either of the deflectors could be formed in any other suitable manner and that although the rubber wiper is desirable to prevent possible binding between the deflectors and the sidewalls while maintaining an effective wiping or scraping action, other suitable arrangements, including additional clearance between the scrapers and the sidewalls, will be satisfactory. The separator shown in FIGS. 8, 9, 10 and 11 operates in essentially the same manner as the separator shown in FIG. 4, but because of its three friction wedges and larger size is able to handle a large volume of particulates with minimal decrease in separator efficiency. The sizing deflectors are mounted upon any convenient primary supporting means, not shown, by means of secondary bracket rods 90 and 91.

While the various parts of the apparatus of the invention have been referred to above by specific names, it will be understood that other designations may be preferred. For example, the separator plate can be referred to variously as the separator disk, rotating disk, planar bottom disk or first or upper disk or plate, while the collector adjacent to the bottom of the separator disk can be referred to variously as a deflector disk, collector plate or disk or the like. In a like manner the various belt conveyors can be referred to broadly as collecting means which, of course, would include any suitable means for conveying or collecting particulates. Motor means refers to any suitable driving means. The primary deflectors or scrapers which direct fines into the central orifice can be referred to as deflector blades, scraper baldes or means, particulate scrapers or deflectors or particulate or particle baffles. The secondary deflectors which serve to deflect coarse particulates back into the bottom of the separator vessel can be referred to as size deflectors, particulate deflectors, baffles or particulate baffles. The central orifice in the separator plate can likewise be referred to as an overflow orifice or opening, small particulate receiving orifice or the like. Likewise, by angle of inclination with respect to the separator plate or the separator vessel as a whole it is meant the angle of the plate or bottom of the separator with respect to the horizontal when taken with respect to the earth. Since the angle of inclination of the axis of rotation of the separator vessel would normally be displaced ninety degrees from the inclination of the bottom of the separator vessel, assuming that the bottom of the vessel is flat and that its inclination can be easily determined, the inclination of the vessel can also be conveniently expressed by referring to the angle of the axis of rotation. By adding ninety degrees to fifty through seventy five degrees and subtracting this from one hundred and eighty degrees the inclination of the axis of rotation of the separator vessel can be seen to be approximately fifteen to forty degrees from the horizontal with a tolerance of perhaps five degrees either way. The preferred angle of inclination of the axis of rotation will be about twenty-five to thirty-five degrees.

In referring to the angle of the sidewalls of the separator vessel an outwardly flared sidewall may be defined as having an obtuse angle with respect to the bottom or separator plate. An inwardly flared sidewall or member may be defined as having an acute angle with respect to the separator or bottom plate. The sidewalls or side members may be referred to variously also as the peripheral sidewalls or circumferential sidewalls. The angle of the sidewall when such sidewall is a secondary peripheral sidewall is with respect to the circumferential ring or surrounding ring through which said peripheral sidewall is secured to the first or principal sidewall. Alternatively the angle of the sidewall may be defined with respect to the horizontal. The effective angle or inclination of the sidewall is, as explained above, the angle or inclination which the sidewall has or would have if it is without friction wedges or other discontinuities. This angle is invariable from just less than horizontal to ten to fifteen or so degrees below, or less than, horizontal extending away from the bottom of the separator vessel with a tolerance of perhaps five degrees either way depending upon the material being handled.

The area between a sidewall and the adjacent bottom or separator plate or adjacent circumferential ring, as the case may be, is in appropriate cases referred to variously as a trough, groove, concavity, friction trough or friction wedge area when the angle is either a right angle, an acute angle or not more than two to five degrees more than ninety degrees, i.e. not more than two to five degrees into being an obtuse angle. The rotating portion of the separator device of the invention may be referred to as a whole as the separator vessel, separator or rotating separator means. While the primary deflector or scraper blade has been described as necessarily extending from an upper edge of the separator to the far upper edge, with respect to rotation of the separator vessel, of the central orifice, it may also be described as extending to the downwardly moving edge of the central orifice.

The sidewalls of the separator vessel will normally extend circumferentially about the periphery of the bottom plate of the separator, but, as shown in FIG. 5, may extend only about a portion of the surface of the bottom plate. This may be referred to as being circumferentially disposed completely about at least a portion of the surface of the bottom plate.

While the separator of the invention has been described and illustrated as having a flat planar bottom and more or less regular curvilinear sidewalls circumferentially disposed with respect to the bottom and meeting the bottom at a definite angle, it will be understood that the bottom and sides could be formed with curved or curviform surfaces which mold or blend into each other between the front lip of the sidewalls and the rear orifice of the bottom so long as the general shape described is maintained.

The apparatus of the invention has been found to be particularly useful in sizing coal particles, and particularly damp coal particles which tend to quickly plug or blind a conventional screen, but may be used for the sizing of other particulates such as ore particles and the like and particularly iron ore. Large tonnages of both coal and iron ore can be passed through the apparatus and effectively sized in a short time and with a minimum expenditure of energy. Relatively small horsepower motors are effective to rotate rather large separator vessels, particulately once the vessel has been brought to operating speed.

I claim:

1. A particulate size separation device comprising:
(a) a substantially circular separator rotatably mounted with its axis of rotation disposed at an inclination of from 15 to 40 degrees above horizontal comprised of:
(i) a substantially planar bottom disk having a central orifice and disposed at an inclination above horizontal of from 50 to 75 degrees,
(ii) a sidewall circumferentially disposed completely about at least a portion of the surface of said planar disk and extending from the disk substantially perpendicularly with respect to the upper surface of the disk to a free outer lip of the sidewall,
(iii) the lower edge of the central orifice in the planar bottom disk being positioned at a higher elevation than the lowermost position of the outer lip of the sidewall,
(b) a scraper mounted in close proximity to the surface of said planar bottom disk and extending from an upper portion of said sidewall to near the downwardly moving edge of said central orifice,
(c) drive means for rotating said separator,
(d) first collecting means disposed adjacent to the central orifice for receiving relatively fine particulates passing through the central orifice,
(e) second collecting means disposed adjacent to the outer lip of the sidewall at substantially the lowermost position of said lip for collection of relatively coarse particulates passing over the lip, and
(f) feeding means for feeding particulate material to the separator.

2. A particulate size separation device according to claim 1 additionally comprising:
(g) a rotatable collector disk disposed under the bottom disk of the separator and spaced therefrom in a position to deflect relatively fine particles passing through the central orifice into the first collecting means.

3. A particulate size separation device according to claim 2 additionally comprising:
(h) a deflector means extending adjacent to the surface of the planar bottom disk from an upper portion of the sidewall into the vicinity of the upwardly moving edge of the central orifice, the undersurface of the deflector being spaced from the surface of the disk a distance determined to pass relatively fine particulates below a predetermined maximum size in at least one dimension and deflect backwardly and downwardly relatively coarse particulates larger than said predetermined maximum size.

4. A particulate size separation device according to claim 3 wherein the upper surface of the planar bottom disk is roughened to provide additional friction between the surface and particulate material in contact with said surface.

5. A particulate size separator device according to claim 4 wherein the inner surface of the sidewall is roughened to provide additional frictional interaction with said particulates.

6. A particulate size separation device according to claim 1 additionally comprising:
(g) a circumferential planar ring disposed outwardly of the upper edge of the sidewall,
(h) a sidewall circumferentially disposed completely about at least a portion of the circumferential planar ring at an angle between substantially perpendicular with respect to the upper surface of the circumferential planar ring and substantially parallel to horizontal.

7. A particulate size separation device according to claim 6 including a plurality of circumferential planar rings and sidewalls disposed adjacent each other to form a series of friction troughs.

8. A particulate size separation device according to claim 7 wherein there are several circumferential planar rings and sidewalls disposed with respect to each other at substantially similar angles to form a series of circumferential friction troughs radially of each other.

9. A particulate size separation device according to claim 6 wherein the sidewall and circumferential planar ring of subparagraphs (g) and (h) are disposed substantially perpendicularly with respect to each other.

10. A particulate size separation device according to claim 9 wherein the upper surface of the planar bottom disk and the upper surfaces of the circumferential planar rings are roughened to provide additional frictional relationship between said surfaces and particulates in contact with said surfaces.

11. A particulate size separation device according to claim 8 wherein both the surfaces of the peripheral sidewalls are roughened.

12. A particulate size separation device comprising:

(a) a separation vessel rotatably mounted with its axis of rotation disposed at an inclination of from 15 to 40 degrees above horizontal comprised of:
  (i) a substantially planar bottom plate disposed at an inclination of from 50 to 75 degrees above horizontal and having a central orifice coextensive with the axis of rotation,
  (ii) a sidewall disposed circumferentially and completely about at least a portion of said bottom plate and extending from said bottom plate to a free outer lip of the sidewall at a substantially uniform angle with respect to the upper surface of the bottom plate of from about 90 degrees to said surface to about 15 degrees downwardly from horizontal and having an effective angle of from approximately horizontal to 15 degrees downwardly from horizontal,
  (iii) the lower edge of the central orifice in the planar bottom plate being positioned at a higher elevation than the lowermost position of the outer lip of the sidewall,
  (b) drive means for rotating said separation vessel,
  (c) means for feeding particulate material into said separation vessel, and
  (d) means to collect relatively fine particulate material adjacent said central orifice and relatively coarse particulate material adjacent the outer lip of the sidewall at substantially the lowermost position of said lip.

13. A particulate size separation device according to claim 12 wherein the sidewall is disposed at an obtuse angle with respect to said bottom plate.

14. A particulate size separation device according to claim 12 wherein the sidewall is disposed substantially perpendicularly with respect to the surface of said bottom plate.

15. A particulate size separation device according to claim 14, wherein there are at least two perpendicular sidewalls and a circumferential ring connecting said sidewalls.

16. A particulate size separation device according to claim 15 additionally comprising:

(e) a collection plate disposed adjacent said central orifice to receive said fine material and transfer it to said collection means.

17. A particulate size separator according to claim 16 wherein the surface of the separator plate, the surface of the circumferential rings and the surface of the peripheral sidewalls are roughened to provide additional frictional interaction between said surfaces and particulate material in contact with said surfaces.

18. A method of separating relatively fine particulates from relatively coarse particulates comprising:

(a) feeding a particulate material containing both coarse and fine particles into an inclined rotating separator vessel having:
  (i) a flat substantially circular bottom,
  (ii) a sidewall circumferentially disposed completely about at least a portion of said bottom and extending away from said bottom at an angle between substantially perpendicular to said bottom to 15 degrees below horizontal, said sidewall having an outer lip,
  (iii) a primary particulate deflector having its lower edge substantially against the bottom,
  (iv) a secondary particulate deflector having its lower edge adjacent to the bottom,
  (v) a central orifice in said bottom,
(b) adjusting the speed of rotation of said separator vessel to about 100 to 600 lineal feet per minute adjacent the periphery of the separator vessel,
(c) adjusting the inclination of the axis of rotation of said separator vessel to between about 15 to 40 degrees above horizontal so that the bottom of the separator vessel has an inclination of about 60 to 75 degrees above horizontal and the bottom of the central orifice is positioned at a greater elevation than the outer lip of the sidewall,
(d) adjusting the distance between the secondary particulate deflector and the bottom of said separator vessel to be between one to three times the diameter of fines which are to be separated from the remainder of the particulates the gap between the deflector and the bottom being maintained such that the total cross-sectional area of said gap is at least equal to the instantaneous cross-sectional area of the volume of finer to be passed through it per unit time,
(e) allowing a churning mass of particulates to accumulate in the area between the bottom of the rotating separator vessel and the sidewall, and
(f) adjusting the relative rotational speed, angle of inclination and gap size within the foregoing limits such as to attain the size separation desired.

19. A method of separating particulates in accordance with claim 18 in which the inclination of the separation vessel is maintained between 25 to 35 degrees with respect to the horizontal.

* * * * *